US005820931A

United States Patent [19]

Kreiselmaier

[11] Patent Number: 5,820,931

[45] Date of Patent: Oct. 13, 1998

[54] COATING TUBE PLATES AND COOLANT TUBE

[75] Inventor: Richard Kreiselmaier, Bottrop, Germany

[73] Assignee: Dipl.-Ing. Ernst Kreiselmaier Wasser-und Metall-Chemie KG, Bottrop, Germany

[21] Appl. No.: 330,629

[22] Filed: Oct. 28, 1994

[30] Foreign Application Priority Data

Apr. 22, 1994 [EP] European Pat. Off. ..... 94106304

[51] Int. Cl.[6] ..... B05D 7/22

[52] U.S. Cl. ..... 427/230; 427/239; 427/292; 427/385.5; 427/388.1; 427/430.1; 427/435

[58] Field of Search ..... 427/292, 239, 427/230, 385.5, 388.1, 435, 430.1

[56] References Cited

U.S. PATENT DOCUMENTS

| | | | |
|---|---|---|---|
| 3,689,311 | 9/1972 | Loeffler et al. | 427/292 |
| 4,795,662 | 1/1989 | Kreiselmaier | 427/230 |

FOREIGN PATENT DOCUMENTS

| | | |
|---|---|---|
| A0236388 | 9/1987 | European Pat. Off. . |
| 1939665 | 2/1971 | Germany . |
| A2515007 | 10/1976 | Germany . |
| 7702562 U | 1/1977 | Germany . |
| 1175157 | 12/1969 | United Kingdom . |
| WO87/01437 | 3/1987 | WIPO . |

*Primary Examiner*—Janyce Bell
*Attorney, Agent, or Firm*—McDermott, Will & Emery

[57] ABSTRACT

Coating for the tube beds and heat exchanger coolant tubes extending from them, especially steam condensers, based on hardening plastic mixtures, obtainable by cleaning the surfaces provided for coating using an abrasive; closing the tube inlets and outlets with removable plugs; applying at least one layer of a hardening plastic coating on the tube bed; allowing the coating to harden so that additional mechanical processing can ensue, and processing the surface; removing the plugs from the tube inlets and outlets as well as applying at least one layer of a hardening plastic coating at least in the inlet area of the coolant tube, and allowing it to harden, coating of the coolant tubes by timed applications being done reactively to the tube bed coating and the coolant tube coating exhibiting in comparison to the tube bed coating a greater elasticity having an elongation at tear at least 2% greater in accordance with DIN 53152 with respect to the elongation at tear of the tube bed coating, and process for coating tube beds and coolant tubes extending from them.

9 Claims, 5 Drawing Sheets

COATING TUBE PLATES AND COOLANT TUBE

BACKGROUND OF THE INVENTION (a) Field of the Invention

The invention relates to a coating for tube beds and heat exchanger coolant tubes extending from them, especially steam condensers, based on hardening plastic mixtures that can be obtained by cleaning the surfaces provided for coating using an abrasive; closing the tube inlets and outlets with removable plugs; applying at least one layer of a hardening plastic coating (for mixture) on the tube bed; allowing the coating to harden so that additional mechanical processing can ensue, and processing the surface; removing the plugs from the tube inlets and outlets, as well as applying at least one layer of a hardening plastic coating at least in the inlet area of the coolant tube, and allowing it to harden, as well as a process for coating the tube bed and heat exchanger coolant tubes extending from these.

(b) Summary of Related Art

How to provide tube beds having heat exchangers, as they are for example employed in facilities for production of electrical energy, with a coat of plastic to counteract the effects of corrosion is known. Tube beds and the coolant tubes extending from them are subject to a variety of external influences, especially mechanical, chemical, and electromagnetic stresses. Mechanical stresses occur as a result of solid particles carried along by the coolant, sand, for example. In addition, enlargements in the roll in section, an area of the tube of the coolant tubes on the tube bed occur as a result of the difference in temperature between the coolant and the steam to be condensed, which can exceed 100° C.

Chemical stresses result from the nature of the coolant, for example, from its loading with salts or acid substances. In particular, remark should be made in this regard about the known corrosive effects of sea water or heavily-loaded river water employed for coolant purposes. The electro-chemical or galvanic corrosion that should be mentioned is that which occurs as a result of development of galvanic elements on metallic border surfaces, especially at the transitions from the tube beds to coolant tube, and which is strongly promoted by electrically conductive liquids like sea water. In addition, there are limitations on the functionality of the tube bed as a result of deposits of undesirable materials, formation of algae, etc., on its surface, which is particularly promoted by surface roughness resulting from the effects of corrosion. This has as its result that the effects of corrosion and deposits accelerate with the age of the tube bed because they increasingly form new locations for corrosion and deposits to take hold.

From very early on, therefore, steps have been taken to provide tube beds with a coating of plastic material that reduces corrosion. In particular, thick coats of epoxy resin were used for this purpose, these being adapted to the tubing inlets and outlets using certain techniques, for example, by using formed plugs during application. In this way coating of the tube beds can initially be adapted seamlessly at the tubing inlets and outlets, interior coating of the mostly non-corrosive materials remaining at the ends of the tubes or in the area of the coating generally being dispensed with. But even in such solutions, coolant water could penetrate over time through microcracks and therefore could certainly not prevent development of galvanic elements; this having as its result an increasing incidence of corrosion after formation of the first crack. Even including the coolant tubes in the coated surface, at least in the area of its inlet and outlet, achieved only limited improvements, since the prevailing extreme thermal and mechanical stresses in this area lead to formation of hair-cracks in exactly the sensitive area that transitions from tube bed to coolant tube. If, however, the bond between the tube bed and the tube coating is broken even once at these locations, the protective effect of the coating is increasingly affected.

Measures of the type just described are known, for example, from GB-A-1 175 157, DE-U-1 939 665, DE-U-7 702 562, and EP-A-0 236 388.

Considering the previously described problems, the task of the invention is based on providing the tube bed and the coolant tube inlets and outlets adjacent to the tube bed an integrated coating for both, which coating offers long-term resistance to the mechanical stresses at the transition points and which at the same time is suitable for resisting chemical stresses resulting from the coolant.

SUMMARY OF THE INVENTION

This task is solved using a coating of the type described at the beginning, in which the coolant tubing or (tube) coating is affixed reactively to the tube bed coating by timed application and in which the coolant tube coating exhibits in comparison to the tube bed coating a greater elasticity having an elongation at break at least 2% greater in accordance with DIN 53152 with respect to the elongation at break (or elongation at tear) of the tube bed coating.

Timing the coating processes on the tube bed and in the coolant tubes allows cross linking between the coating edges of the coating in the tubes and the tube bed coating to occur, so that there is a chemical bond especially capable of bearing. At the same time and additionally, the relatively greater elasticity of the coolant tubing coating effects better resistance to mechanical stress in the inlet and outlet areas of the tube at those locations that experience galvanic corrosion. It has been demonstrated that an increase of 2% in the elongation at tear in accordance with DIN 53152 is in general sufficient to effect the improvement in the coating bond, an elongation at tear in the tube bed coating of less than 5% and in the coolant tube coating of less than 10% being assumed, in order to provide the hardness, resistance to abrasion, and compressive resistance necessary for the durability of the coating. On the other hand, for the tube bed coating, elongation at tear should not fall below 2% in order to avoid brittleness. Materials having elongation at tear in accordance with DIN 53152 of 2 to 4% have proved particularly suitable for the tube bed, and 4 to 9% for the coolant tubes. Of particular advantage are coatings having elongations at tear of more than 3% for the tube bed and more than 5% for the coolant tubes.

In order to apply the layers of coating necessary for lasting operation over several years and at the same time to ensure quality relative to adhesion and freedom from pore and hairline tears, it is useful to apply the coating in accordance with the invention in multiple layers, each layer being applied to the still-reactive surface of the layer underneath, in order to achieve chemical cross linkage. For purposes of utility, two or three layers are applied both to the tube bed and to the coolant tubes; these may be differently colored in order to allow coloration to be used to inspect remaining thickness of the coating from time to time. The minimum layer thickness of the entire coating for the interior coat of the tubes is at least about 80 $\mu$m and for the tube bed is at least 2000 $\mu$m. Layer thicknesses of 20 mm and more are easily possible without suffering losses in fastness. This is a particular advantage when working with coating tube beds that are already heavily corroded and that exhibit deep scars from corrosion.

It has proved to be very useful to provide the cleaned surfaces of the tube bed and the coolant tubes with a primer prior to applying the actual coating; the primer is generally sprayed on in a less viscous state and penetrates into the cavities and scars caused by corrosion. This accomplishes a leveling of the surfaces, better reduction of irregularities, and overall better adhesion of the actual coating. Likewise, the actual coating can be provided on the surface together with a sealant, especially in order to achieve a smoother surface that prevents adhesion of algae, contaminants, etc. The sealant in the area of the tube bed is preferably adjusted to be more elastic than the tube bed coating, and the sealant should adhere to the previously-mentioned values for elongation at tear exhibited for the coolant tube coating. In general it is useful to provide two layers of both primer and sealant. Sealing the tube area is generally not necessary.

Preferred materials for the coating in accordance with the invention are cold-setting epoxies that are distributed with an amine hardener. These resinous compounds contain conventional fillers and dyes, set-up agents, stabilizers, and other common additions in order to ensure desired characteristics, especially processibility and durability. These are conventional plastic mixtures, as they can be used for other purposes as well—for the coating in accordance with the invention, the type of hardening plastic is much less important than its resistance to corrosion and its elasticity after hardening. Besides epoxies, other cold-setting plastics that meet these requirements may also be employed. Epoxy/amine systems, however, are preferred for the purposes of the invention.

The plastic mixtures used for the tube bed and especially for the coolant tubes contain for purposes of functionality some powder-form polytetrafluor ethylene (PTFE) in the amount of at least about 5% by weight in order to achieve the desired values of elasticity and fastness. It has been demonstrated that an addition of PTFE in the range of 5 to 20% by weight, especially about 10% by weight, significantly improves the durability of the coating in the area of the tube inlets and outlets. The PTFE addition, for example, Hostaflon ® from Hoechst, should have a grain of <50 $\mu$m and in particular in the range of 10 to 30 $\mu$m. It forms a matrix that fills, stabilizes, and effects an improvement in elasticity, and in particular also serves to adjust the desired elasticity.

A content of >30% by weight mineral additions in the mixture is useful to increase resistivity, especially of the tube bed coating.

In order to further improve the durability of the coating in accordance with the invention in the area of the transition from the coolant tube to the tube bed, it can also be useful to add a plastic sheath to the coating in the area of the transition to the tube bed, which sheath brings about an additional stabilizing effect.

It has been demonstrated that the coatings in accordance with the invention must meet certain criteria with respect to mechanical stressability. The hardness finally achieved in the coating should reach a value of at least about 75 in accordance with DIN 53153 (Barcol hardness), preferably at least 80. A value of at least 95 is useful for the tube bed coating.

In addition, the adhesive strength of the coating on the base should be at least about 4N/mm$^2$ in accordance with DIN Iso 4624, preferably at least about 5N/mm$^2$, and in particular at least 7N/mm$^2$. In accordance with the invention, adhesive strengths of more than 10N/mm$^2$ for the tube bed coating and more than 5N/mm$^2$ for the coolant tube coating and primer are achieved.

Compressive strength and resistance to abrasion are essential for the stability of the invented coatings. With regard to compressive strength, values of more than 50N/mm$^2$ for the coolant tube coating and more than 100N/mm$^2$ for the tube bed coating should be achieved; for resistance to abrasion according to DIN 53233 (Case A) the values should be more than 40 mg and more than 55 mg, respectively.

The invention is furthermore a process for applying the previously described coating, in which initially the surfaces provided for coating are cleaned using an abrasive, the tube inlets and outlets are closed by removable plugs, at least one layer of a hardening plastic coating is applied to the tube bed, the coating is allowed to harden, so that additional mechanical processing can follow, but still-reactive locations on the surface remain, after which the surface is mechanically processed. Then the tube plugs are removed from the tube inlets and outlets and at least one layer of a hardening plastic coating is applied to the entrance area of the coolant tube forming a reactive bond with the tube bed coating, the plastic mixture being selected in such a manner that the coolant tube coating exhibits in comparison to the tube bed coating a greater elasticity having an elongation at tear at least 2% greater in accordance with DIN 53152 with respect to the elongation at tear of the tube bed coating.

It is important for the process in accordance with the invention that the surfaces provided for coating are thoroughly abrasively cleaned in order to create a fixed and uniform base. There are two reasons for closing the tubing inlets and outlets with removable plugs, which in and of itself is known. First, penetration by the mass provided for coating the tube bed into the tube inlets is to be prevented; second, the tube bed coating is to be adjusted to the course of the coolant tube and corresponding contouring is undertaken, to which appropriately shaped plugs are related. In this way in particular the tube inlet is formed in a manner favorable for flow and a section for joining the coolant tube coating to the tube bed coating is easily provided. It can make sense, especially for older tube beds, to mold the coolant tube at the inlet and outlet as needed in order to ensure a smooth transition to the embedding of the tubing inlets in the tube bed coating (DE-U-7 702 562). This achieves in particular that the tube bed/coolant tube transition does not coincide with the coating for the tube bed/coolant tube coating, which increases the life expectancy of the coating.

Cleaning the surfaces to be coated is preferably done by blasting using an abrasive, for example, sandblasting. In the next step, the tube inlets are closed with the plugs provided for this use. Then, preferably, a primer is applied, especially a primer having a coating mass that achieves the elasticity characteristics of the coating provided for the coolant tube. Since it is useful to apply the primer in a spraying process, the appropriate plastic mixtures should exhibit appropriate viscosity, also with respect to the ability to penetrate the corrosion scars in the metal surface. The thickness of the layer should be at least about 80 $\mu$m. Drying time for epoxy is about 8 hours to a few days at 20° C., it being ensured in this period that a still-reactive bond for the subsequent layer can be formed. A roller process may also be selected for application, however.

One to three layers of the plastic mass provided for the tube bed are applied over the primer, especially by spatula, in order to ensure penetration into cavities, to eliminate hollow spaces, and to avoid formation of pores and bubbles. For this it has proved useful to apply multiple layers to achieve the necessary layer thicknesses of 20 mm or more. Drying time until further processing is about 24 hours up to 4 days for epoxy. After hardening, the surface is mechanically polished, especially by processing using an abrasive. The polishing process is useful because it achieves a uniform surface that provides less resistance to the coolant appearing on the tube bed and offers fewer locations for mechanical erosive corrosion and accumulations of, for example, algae. During application it should be ensured that the individual layers are reactively bonded to each other.

It is useful to apply a sealant, generally in two coats, over the coating that has been applied by spatula. A plastic mixture having its elasticity adjusted based on the underlying coating serves as the material for this, for example, a mixture such as that described for coating the coolant tubes. The thickness of each individual layer should be at least 40 μm, a total of at least about 80 μm, drying times for epoxy/amine systems are 6 hours to the point when they are no longer tacky. The sealant, especially if sprayed or rolled on, by blending with the plastic mass, achieves further polishing of the surface, so that the surface offers fewer locations for corrosion damage and accumulations to take hold. It is useful not to apply the sealant until the coolant tubes are being coated, at least the last layer of coating applied to the coolant tubes being extended seamlessly onto the coating for the tube bed.

The entire coating can be mechanically and chemically stressed after about 7 days at a hardening temperature of 20° C.

After the tube bed coating is applied to the primer and mechanical reprocessing has occurred, in the next step the plugs are removed from the tubing inlets. Then the coolant tube coating is applied on the cleaned surface in the tubing, at least in its inlet area, but preferably along its entire path, preferably in multiple layers. Spraying has proved to be especially suitable for application, beginning with a jet suitable for this and spraying sideways at the end turned away from the tube bed and coating down to the tube bed. Alternatively, the coating may also be rolled on using a brush saturated with the coating material, the brush rotating and the coating material being thrown against the walls of the tube. The plastic mixtures used for this are adjusted to spraying viscosity, attention being paid both to the greatest possible ability to penetrate and to immediate adhesion without formation of drips. It is also useful to apply multiple layers, initially a primer in one or two layers on the metal surface, which for epoxies hardens in 8 hours to 8 days, and then the actual coating in one or more layers, with a hardening time of 6 hours to 4 days. Subsequent processing for the coolant tube coating is not necessarily required. As described above, at least the last layer of the tube coating is applied to the tube bed coating in one stroke, where it serves as a sealant.

The individual layers of the tube coating and sealant are applied in a thickness of at least about 40 μm; the entire dry coating thickness for lasting corrosion protection should be at least about 80 μm. In applying multiple layers it is important to pay attention to time; both the transition to the coating of the tube bed coating and the individual layers of the coolant tube coating must be applied within a time period that allows development of chemical cross linking with the underlying layer.

The coolant tube coating can also be chemically and mechanically stressed after about 7 days. The times given refer to epoxy/amine systems and 20° C.

The coating in the coolant tubes, if it is not continuous, should taper off layer by layer, so that there is a gradual flattening. It is useful to go into and up the bare metal of the coolant tube with each successive outer layer, so that the underlying layer is completely covered by the layer on top of it. Each outer layer may also begin farther to the outside than the underlying layer, however.

It is useful for all coatings to color the individual layers differently in order to be able to control the coating and its thickness. By simply using a grey primer and alternating red and white layers for the total coating on top, it is possible to control the remaining layer thickness using the coloration and, for example, to determine when the next-to-the-last and the last layers have been reached. In this manner it is possible to fully exploit the life expectancy of the coating and to conduct specific repairs at locations particularly affected by corrosion or erosion, these distinguishing themselves from their surroundings by their differing coloration.

BRIEF DESCRIPTION OF THE DRAWINGS

The invention is explained in more detail using the following illustrations. These show.

DETAILED DESCRIPTION

Figure 1C:
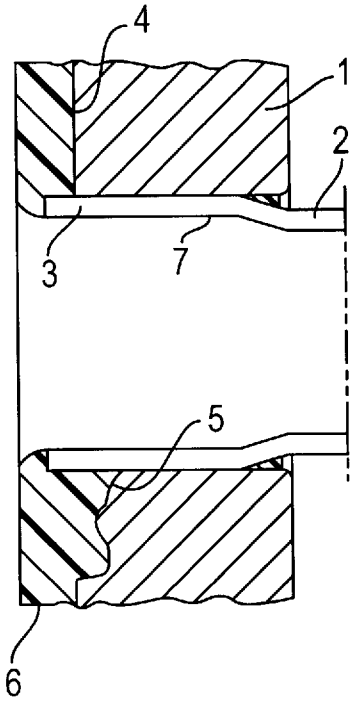
FIGS. 1(*a*), (*b*) and (*c*) in cross-section, the condition, not corroded and corroded, of a tube bed having a coolant tube inlet, each having coatings, in three variants, 1(*a*) through 1(*c*)
Figure 1B:
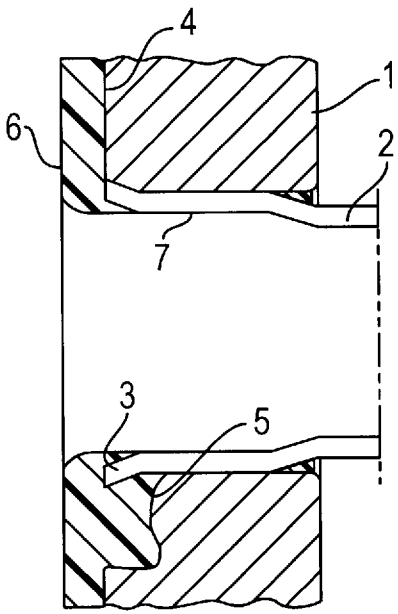
Figure 1A:
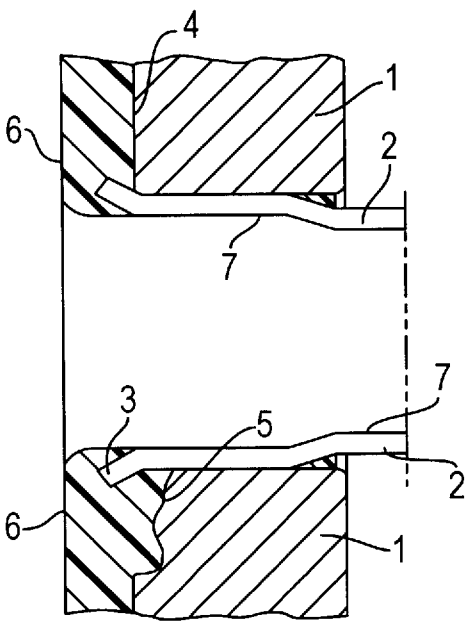

FIG. 1(*a*) illustrates in cross-section a tube bed 1 having a coolant tube 2. The projecting end of the tube 3 in the area of the coolant tube inlet is bent or pressed to the sides. In the top half of the illustration (also in FIGS. 1(*b*) and (*c*)), the tube bed exhibits an intact polished surface 4, as it practically only occurs in new condition, given no particular protection. In the lower half of the illustration, the surface of the tube bed is significantly damaged by the effects of corrosion, especially in the area of the coolant tube entrance, deep corrosion scars having developed by galvanic corrosion.

The darkened parts in the area of the tube bed surface 4 represent a coating 6 having a cold-setting plastic mixture suitable for it. The coating 6 passes over into the coolant tube coating. The corrosion scar 5 is completely filled by the coating. Since the coating mass itself is practically chemically inert, the tube bed 1 and the tube 2 are completely protected from the damaging cooling water. This essentially eliminates galvanic corrosion.

FIGS. 1(*b*) and (*c*) show common variants of the coolant tube extension with flush end (1*b*) and with projecting end not pressed outward (1*c*), in each case (1*a* through 1*c*) the tube end 3 being completely integrated in the coating 6, 7.

Figure 2:
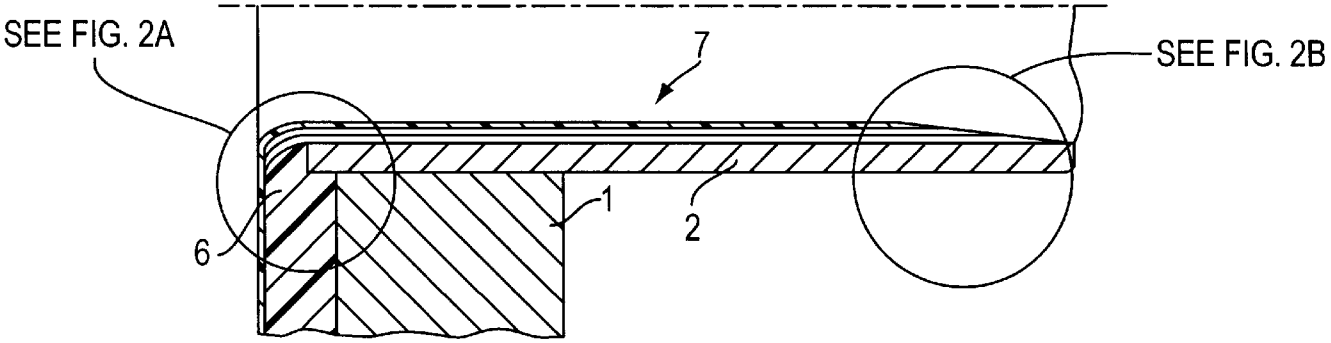
FIGS. 2, 2A, 2B the coating in accordance with the invention of a tube bed and an entering coolant tube in its layered construction.
Figure 2B:
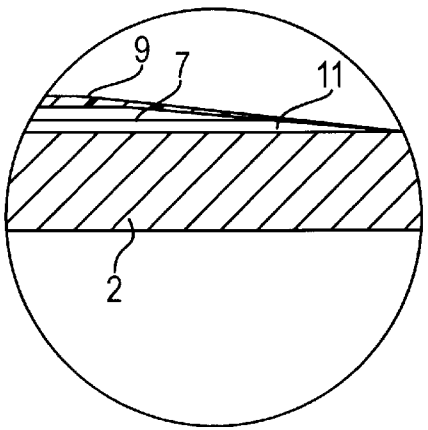
Figure 2A:
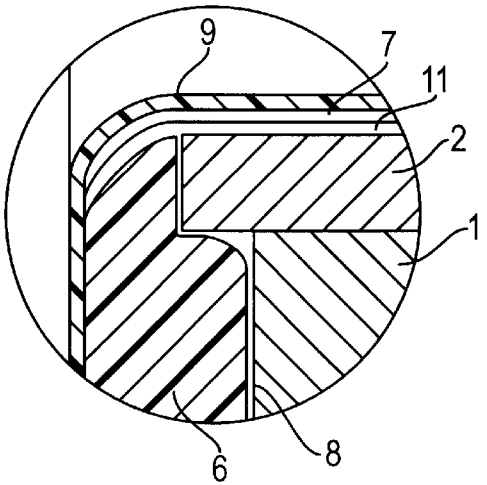

FIG. 2 shows the layered construction of the coating in accordance with the invention. Details of the tube bed coating and the tube coating are shown in sections A and B (FIGS. 2A and 2B).

The tube bed 1 itself exhibits a primer 8 underneath the actual coating 6, the primer filling in smaller irregularities. The polished surface of the coating 6 is initially protected by a sealant 9 that runs into the tube and forms the exterior layer in the tube coating.

The wall 2 of the coolant tube is initially provided with a primer 11 on the cleaned metal surface. The actual coolant tube. coating 7, adjusted elastically with respect to the coating for the tube bed, is applied to this base 11. In the case illustrated, the coolant tube 2 is not coated over its entire length, but rather only in the entry area, the coating running out conically in its entirety (Section B), e.g., each of the layers projecting farther into the tube than the layer beneath it. The final layer in the coolant tube coating 9 is also the sealant 9 for the tube bed coating 6. The bent outlet of the tube coating (11, 7, 9) represented in cut A is given by the contour of the plugs provided during coating of the tube bed, which is removed prior to coating the coolant tube.

The total thickness of all layers in the area of the tube bed is >2000 $\mu$m and in the area of the tube sides is >80 $\mu$m; thicker layers can be easily achieved.

DESCRIPTION OF DIN 53152

DIN 53152 is a mandrel bend test on coatings, used primarily on paints and similar coatings. The method described herein uses a cylindrical mandrel, and it is related to International Standard ISO 1519: 1973 issued by the International Organization for Standardization (ISO), see explanations.

1 Scope and field of application 1.1 This Standard specifies a method for assessing the resistance of paints, varnishes and similar coatings (in the following, in short coatings) to cracking and/or detachment from a metal or plastic substrate, when provided as a plate and subjected to bending round a cylindrical mandrel (or a plate having a respectively rounded edge) under standard conditions.

1.2 The mandrel test may be carried out a) either as a "go/no go" test, by carrying out the test with a single specified size of mandrel—to assess compliance with a particular requirement;

b) or by repeating the test using successively smaller mandrels to determine the diameter of the first mandrel over which the coating cracks and/or becomes detached from the substrate.

For a multicoat system, each coat may be tested separately or the complete system may be tested.

2 Apparatus 2.1 Bend test apparatus (For commercial sources of apparatus, please inquire with: DIN-Bezugsquellen für normgerechte Erzeugnisse in DIN, Burggrafenstraβe 6,1000 Berlin 30.)

2.1.1 Requirements

For testing, apparatus may be used fulfilling the following requirements:

The mandrels shall be massive and consist of corrosion-resistant steel.

With apparatus with a replaceable mandrel, replacement must be easy.

In particular with a mandrel of a mandrel having a diameter of 2 mm it must be guaranteed that the mandrel is not deformed during bending. Mandrels showing deformation are not suited for the test.

In place of a mandrel, a plate with respectively rounded edge may be used.

It must be possible to test with mandrels of different diameters (or plates with respectively rounded edges).

The test panels must be introduced into the apparatus in a defined way and must be held in the apparatus such that upon bending no dislocation takes place.

The size of the apparatus is not essential, however, it should be suited to retain test panels having a width of at least 50 mm.

The bending test must be feasible at an angle of 180°.

Both types of apparatus have been found to give similar results with the same coating; normally only one will be used for testing a given product.

2.1.2 Type 1 bend test apparatus

Figure 3:
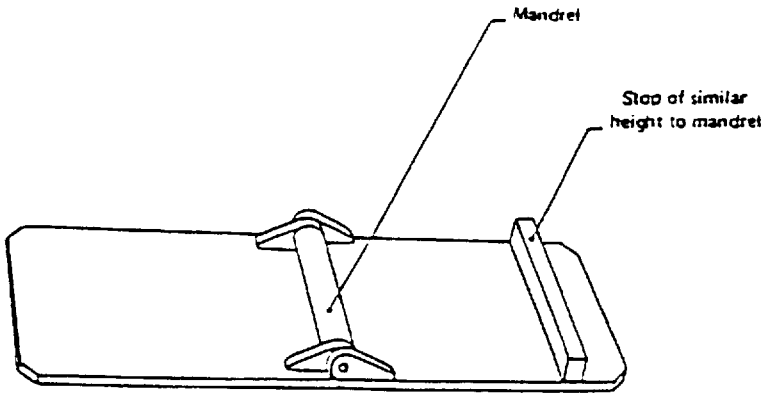
FIG. 3 example of a Type 1 bend apparatus used in DIN 53152.
Figure 4:
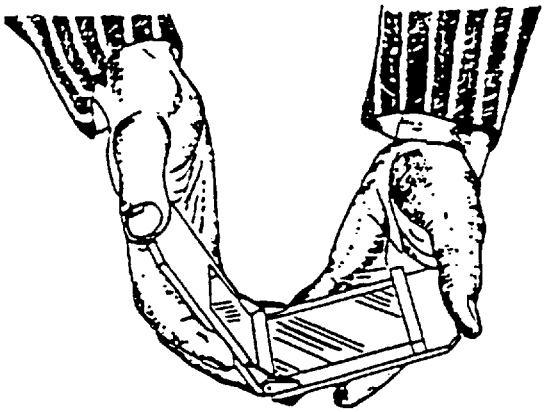
FIG. 4 the use of Type 1 bend apparatus in DIN 53152.

An embodiment of apparatus of type 1 is shown in FIG. 3. The handling of such bending test apparatus is shown in FIG. 4. Test apparatus of type 1 is used with test panels not more than 0.3 mm in thickness. A set of apparatus of type 1 is required, each having a cylindrical mandrel with a diameter selected from the series 2, 3, 4, 5, 6, 8, 10, 12, 16, 20, 25 and 32 mm respectively (deviation limit ±0.1 mm). The gap between the surface of the mandrel and the two plates of the hinges shall be (0.55±0.05) mm.

The mandrel shall be free to rotate on its axis and the apparatus shall be provided with a stop to ensure that when the test panel is bent, the two portions are parallel.

2.1.3 Type 2 bend test apparatus

Figure 5:
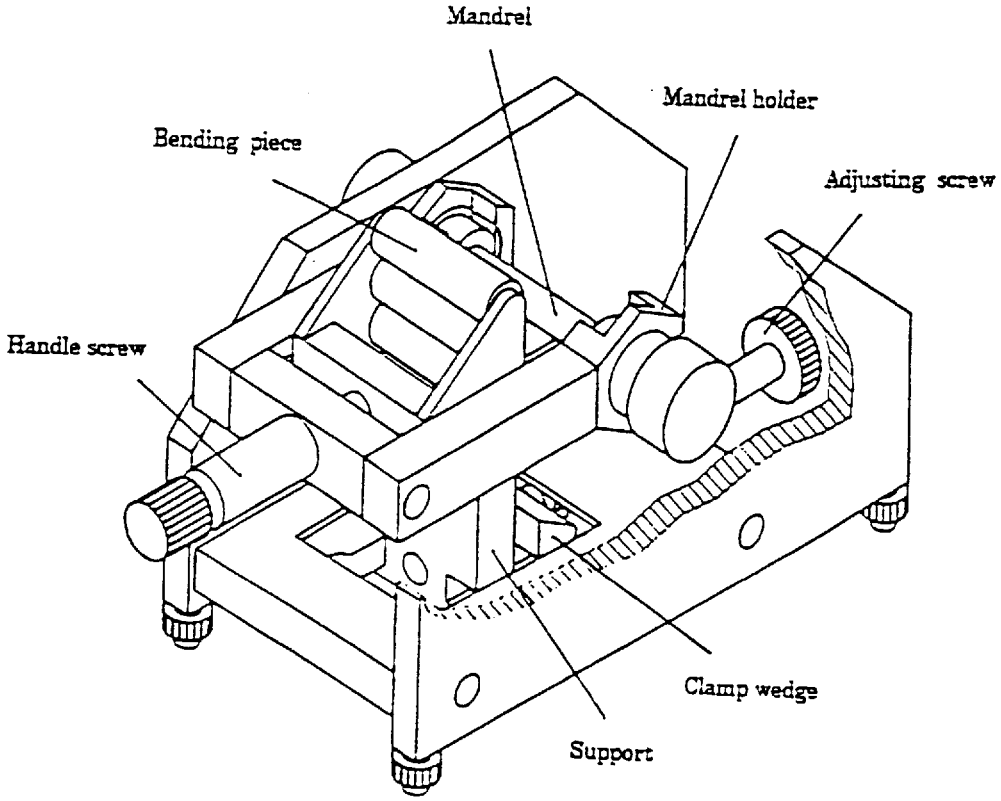
FIG. 5 example of a Type 2 bend apparatus used in DIN 53152.
Figure 6:
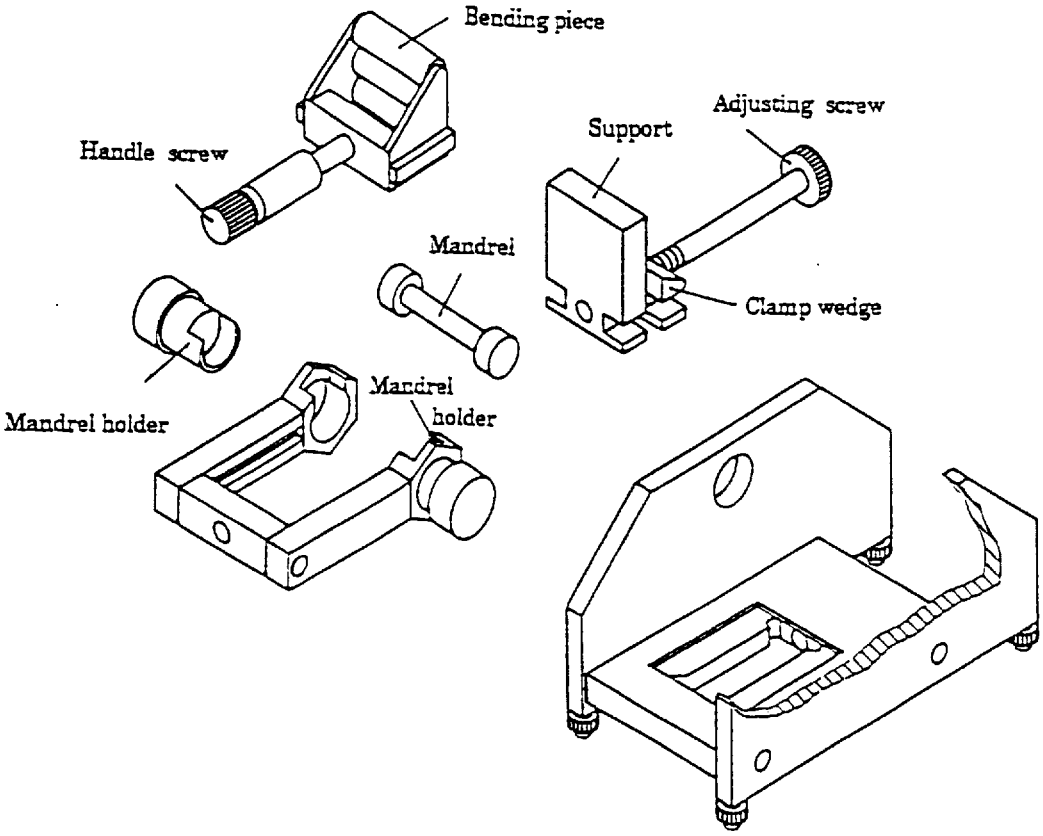
FIG. 6 detail of Type 2 bend apparatus illustrated in FIG. 5.

An embodiment of a bend test apparatus of type 2 is shown in FIGS. 5 and 6. A type 2 bend test apparatus is normally used with test panels of a thickness up to 1.0 mm. With coatings on soft metals, for example aluminum, and on plastics, thicker panels may be used provided there is no distortion of the mandrel (see section 4.3). The diameters of the mandrels are 2, 3, 4, 5, 6, 8, 10, 12, 16, 20, 25, and 32 mm (deviation limit: ±0.1 mm), respectively.

REMARK: With the type 2 bend test apparatus shown as an example, the bending piece consists of three rolls arranged rotatably one aside the other. This prevents the coating from being damaged and subjected to shear stress.

2.2 Controlled temperature chamber

When tests are specified to be carried out at temperatures other than (23±2)°C. (see section 5.1), a test chamber is required. Suitable are, e.g. a heat chamber or refrigerator in which the test temperature is set to and can be controlled to within ±1° C. over the test.

2.3 Magnifying-lens, with 8-fold magnification, e.g. according to DIN 58 383

2.4 Apparatus to measure coating thicknesses according to DIN 50 982, part 1 to 3

3 Sampling

A sample of the product to be tested shall be taken as specified in DIN 53 225 and prepared for testing as specified in DIN EN 21 513.

Samples from coated objects have to be taken or selected so that they may be considered representative.

4 Test panels 4.1 Material

Unless other wise specified or agreed, the standard test panels shall be of steel, galvanized steel, tinplate, aluminum as specified in DIN 53 227, or plastic.

4.2 General

The test panels must be flat and free from distortion. The surface shall be free from visible ridges or cracks.

REMARK: If necessary, in particular with plastics, it has to be clarified in a preliminary test that non-coated test panels withstand the bend test without formation of cracks in the surface and/or breaking.

4.3 Dimensions

The dimensions of the test panels conform to the test apparatus. The test panels shall be rectangular and, unless specified or agreed upon, 100 mm×50 mm.

The thickness of the test panels for a type 1 bend apparatus shall be 0.3 mm. For a type 2 bend apparatus the thickness of the test panels shall be 1.0 mm; by agreement thicker test panels (for example from plastic up to 4.0 mm thickness) may be used.

The thickness of the used test panels must be mentioned in the test report.

The test panels may be cut to size after coating and drying, provided no distortion occurs. In the case of aluminum panels, the longer side shall be in machine direction (e.g. direction of rolling).

4.4 Preparation and coating of panels

The test panels shall be prepared in accordance with DIN 53 227, or as agreed upon, and, unless otherwise specified, shall be coated by the specified method with the product or coating system under test. If the product under test is applied by brushing, the brush marks shall be parallel to the longer side of the panel.

4.5 Drying the test panel

The coated test panels shall be dried (or stoved or aged, respectively) for the specified time and, unless otherwise specified, shall be conditioned at a temperature of (23±2)°C. and (50±5)% relative humidity for a minimum period of 16 hrs under standard conditions specified in DIN EN 23 270. Thereafter the test is carried out as soon as possible.

4.6 Thickness of coating

The thickness of the coating shall be determined according to DIN 50 982 part 1 to part 3 in connection with the standards (see list of "further standards") specified for the individual test methods, as the mean from several determinations of local thicknesses.

5 Procedure 5.1 Test climate

The test shall be carried out under standard conditions according to DIN EN 23 270 (at 23±2)°C. and (50±5)% relative humidity, unless otherwise specified.

5.2 Procedure for a mandrel of given diameter

The appropriate procedure given in sections 5.2.1., 5.2.2 or 5.2.3 shall be carried out on two separate test panels. The test panels shall then be examined as specified in section 5.2.4 (if the results differ, the tests shall be repeated with additional test panels).

5.2.1 Tests with type 1 test apparatus under standard conditions according to DIN EN 23 270 (23±2)°C. and (50±5)% relative humidity The apparatus fitted with the appropriate mandrel, is fully opened, as shown in FIG. 3. The test panel is inserted with the coated side down. Corresponding to the presentation in FIG. 4, the apparatus is closed at a constant speed within 1 to 2 seconds, with a test panel being bent over the mandrel through 180°.

5.2.2 Test with type 2 apparatus under standard conditions according to DIN EN 23 270 (23±2)°C. and (50±5)% relative humidity The apparatus (see FIG. 5) is placed or secured so that it may not be displaced upon testing. The handle must be operable freely, which is possible upon location, e.g. close to the edge of a bench. The test panel is inserted from the top between the bending piece and the mandrel and between the support and the clamp plate. The coat to be tested is on the side opposite to the mandrel. By drawing the adjusting screw the wedge is relocated so that the test panel stands vertical and contacts the mandrel. The test panel is arrested in this position with the clamp plate by turning the adjusting screw. The bending piece is then screwed in with the handle screw so that it contacts the coat. The actual bending test is conducted in the way that the handle is raised evenly through 180° within 1 to 2 sec(s), thereby bending the test panel by the same angle. For removing the test panel from the test apparatus, the handle screw is lowered to its starting position, whereafter the bending piece and the clamp plate with the related handling elements (adjusting screw) are released.

5.2.3 Tests at temperatures other than (23±2)°C.

The test panel is inserted into the bend apparatus with the specified mandrel in accordance with sections 5.2.1 or 5.2.2. Before testing, the apparatus holding the test panel is placed in the test chamber previously adjusted to the specified temperature. There, it stays for two hours, thereafter the bending test being carried out in the test chamber at the specified temperature in accordance with sections 5.2.1. or 5.2.2.

5.2.4 Examination of the test panels

The test panels are examined immediately after bending. In case of a type 1 bending apparatus, the panel can stay in the apparatus. Examination takes place by inspection at normal visual distance or, by agreement, with a lens of X8 magnification. It is examined whether the coat shows cracks and/or detachment from the substrate. The appearance of the surface of the coat within a border zone of less than 10 mm from the edges is ignored.

REMARK: If a lens is used, it is essential to mention this fact in the test report, since the results may be different from those obtained by inspection without optical means.

5.3 Test with mandrels of diminishing diameter for determination of the diameter of the first mandrel to cause failure of the coat The appropriate test according to sections 5.2.1, 5.2.2 or 5.2.3 is carried out with successive test panels, examining each panel as specified in section 5.2.4 and using mandrels of successively smaller diameters until the coating cracks and/or becomes detached from the substrate. Reported is the diameter of the first mandrel to cause cracking and/or detachment of the coat, the result being confirmed by repeating the test with this mandrel on a fresh panel. In the event of failure not occurring with the mandrel of the smallest diameter, this fact is to be reported in the test report.

6 Test report

The test report shall include the following information:

a) The type and identification of the coat material;

b) a reference to this standard;

c) the material (standard designation, if available), surface condition and preparation or conditioning of the substrate, respectively, and the thickness thereof;

d) the type of processing of the coating material (e.g. by spraying);

e) the number of layers;

f) drying conditions;

g) aging;

h) the thickness of coat in $\mu$m (local thickness and mean) and measuring procedure used;

i) the test temperature;

j) the test results (with statement, whether with or without lens):

with test in accordance with section 5.2: "statement for each examination of crack formation and/or detachment of the coat from the substrate upon bending with a mandrel of specified diameter;

with test in accordance with section 5.3: diameter of first mandrel causing cracks in the coat or detachment from the substrate, or the fact that failure did not occur with the smallest diameter mandrel used, in which case the diameter of that mandrel shall also be stated.

k) test conditions deviating from or additional to this standard;

l) the date of the test.

Referenced Standards

DIN 50 982 part 1 measurements of coat thicknesses; general working conditions; terms relating to thickness surficial measurement ranges DIN 50 982 part 2 measurements of coat thicknesses; general working conditions; survey and compilation of usual measurements methods DIN 50 982 part 3 measurement of coat thicknesses; general working condition; selection of methods and measurement procedures DIN 53 225 examination of paints;

DIN 53 227 examination of paints and similar coating materials; preparation of standard test panels from metallic materials or glass lenses;

DIN 58 383 types and optical characterizing data

DIN EN 21 513 paints and varnishes; pre-examination and preparation of samples for further tests DIN EN 21 270 paints, varnishes and their raw materials; temperatures and humidifies for conditioning and testing Further Standards DIN 50 933 measurements of thicknesses; measurement of thickness of coats by differential measurements with a scanning apparatus DIN 50 948 measurements of thicknesses; light intersection method DIN 50 981 measurement of thicknesses; magnetic methods for measurements of thicknesses of non-ferromagnetic layers on ferromagnetic material DIN 50 983 measurement of thicknesses; beta back scattering method for measurements of thickness of coats DIN 50 984 measurement of thicknesses; eddy current method for measurement of thickness of electrically non-conducting layers on non-ferromagnetic base metal DIN 50 986 measurement of thicknesses; wedge cut method for measurement of thickness of paints and similar coats IS 6860:1984 paints and varnishes; mandrel test (with conical mandrel)

Previous Editions

DIN 53 152: 01.54, 10.59, 05.71

Changes

As compared to the edition of May 1971, the following changes have been carried out:

a) The contents have been brought in line with ISO 1519:1973.

b) Plastics have been included additionally as materials for test panels.

Explanations

The present standard was worked out by F-A-Arbeitsausschuβ 8 "Paints and Similar Coatings". It is in factual agreement with international standard ISO 1519:1973 "paints and varnishes—bend test (cylindrical mandrel)" "Peintures et vernis—Essai de pliage sur mandrin cylindrique"—"Lacke and Anstrichstoffe—Dornbiergerversuch mit zylindrischem Dorn".

International Patent Classification

C 09 D 201/00 G 01 L 001/00 G 01 N 033/44

Epoxies that are processed with an amine as hardener have proved to be particularly suitable for the coatings in accordance with the invention. These are common systems that can be adjusted without using a solvent. Suitable products, for example, are epoxies based on glyidyleters and bis-phenol A derived epoxies that are hardened with a common modified polyamine. The epoxy and hardening components contain common additions that control processibility, chemical and storage stability, and resistivity.

I claim:

1. A process for coating a tube bed and coolant tubes of a heat exchanger extending from the tube bed, based on hardening plastic mixtures, comprising the following steps:

cleaning surfaces to be coated with an abrasive; closing the tubes inlets and outlets with removable plugs; applying at least one layer of a hardening plastic coating on the tube bed to form a coating of the tube bed; allowing the coating of the tube bed to harden so that additional mechanical processing of the coating of the tube bed can ensue, and mechanically processing; removing the plugs from the coolant tubes inlets and outlets and applying at least one layer of a hardening plastic coating at least in the area of the coolant tubes entry to form a coating of the coolant tubes, forming a chemical bond between the coating of the coolant tubes and the coating of the tube bed, and the coating of the coolant tubes exhibiting in comparison to the coating of the tube bed a greater elasticity having an elongation at break at least 2% greater in accordance with DIN 53152 with respect to the elongation at break of the coating of the tube bed.

2. A process in accordance with claim 1, wherein the surfaces provided for the coating are cleaned by spraying with an abrasive.

3. A process in accordance with claim 1 or 2, wherein the application of the hardening plastic coating on the tube bed is done by a spatula, after which surface polishing is conducted.

4. A process in accordance with claim 1 or 2, wherein the application of the hardening plastic coating on the coolant tubes is performed by spraying the coolant tubes, or by rolling, beginning at the end turned to the tube bed.

5. A process in accordance with claim 1 or 2, wherein the surfaces are primed prior to applying the hardening plastic mixtures using a spray or roller process and/or a sealant is applied on top of the coating.

6. A process in accordance with claim 5, wherein a layer of plastic having the features of the coating of the coolant tubes is employed as the sealant.

7. A process in accordance with claim 5, wherein multiple layers are applied for each of the base, coating, and/or sealant.

8. A process in accordance with claim 7, wherein layers of differing coloration are applied.

9. A process in accordance with claim 1, wherein the heat exchanger is a steam condenser.

* * * * *